US005363133A

United States Patent [19]

Sugahara et al.

[11] Patent Number: 5,363,133

[45] Date of Patent: Nov. 8, 1994

[54] INK DROPLET JET DEVICE

[75] Inventors: Hiroto Sugahara, Ama; Masahiko Suzuki, Nagoya; Yoshikazu Takahashi, Kasugai, all of Japan

[73] Assignee: Brother Kogyo Kabushiki Kaisha, Nagoya, Japan

[21] Appl. No.: 866,450

[22] Filed: Apr. 10, 1992

[30] Foreign Application Priority Data

May 31, 1991 [JP] Japan ..... 3-129437

[51] Int. Cl.[5] ..... B41J 2/045

[52] U.S. Cl. ..... 347/69

[58] Field of Search ..... 346/1.1, 140 R; 310/333; 29/25.35, 890.1

[56] References Cited

U.S. PATENT DOCUMENTS

| | | | |
|---|---|---|---|
| 4,879,568 | 11/1989 | Bartky et al. | 346/140 R |
| 4,887,100 | 12/1989 | Michaelis et al. | 346/140 R |
| 4,929,256 | 5/1990 | Shepherd | 51/293 |
| 4,940,996 | 7/1990 | Paton et al. | 346/140 R |
| 4,942,409 | 7/1990 | Paton et al. | 346/140 R |
| 4,973,981 | 11/1990 | Bartky et al. | 346/1.1 |
| 4,992,808 | 2/1991 | Bartky et al. | 346/140 R |
| 5,003,679 | 4/1991 | Bartky et al. | 29/25.35 |
| 5,016,028 | 5/1991 | Temple | 346/140 R |
| 5,028,936 | 7/1991 | Bartky et al. | 346/140 R |
| 5,072,240 | 12/1991 | Miyazawa et al. | 346/140 R |

*Primary Examiner*—Benjamin R. Fuller
*Assistant Examiner*—Alrick Bobb
*Attorney, Agent, or Firm*—Oliff & Berridge

[57] ABSTRACT

In the ink droplet jet device of the present invention having a plurality of jet units for jetting an ink in an ink channel from jet nozzles formed on a nozzle plate by changing a volume in the ink channel by using a piezoelectric transducer, two plates are bonded for forming the ink channel. Two piezoelectric ceramic plates having grooves whose widths are larger than widths of the ink channel are provided. Alternatively, one piezoelectric ceramic plate and non-piezoelectric materials can be provided on which the same grooves are formed. When the interval between adjoining ink channels becomes very small to enable an increase in a number of jet nozzles communicating with the ink channels in order to make an image formed by the jetted ink droplet an image of high resolution, the groove processing of the piezoelectric ceramic plate is facilitated because the width of grooves to be ground is very wide in comparison with a conventional device, thereby reducing manufacturing cost.

20 Claims, 3 Drawing Sheets

INK DROPLET JET DEVICE

BACKGROUND OF THE INVENTION

1. Field of the Invention

The present invention relates to an ink droplet jet device, and more particularly to an ink droplet jet device utilizing deformation of a piezoelectric transducer.

2. Description of the Related Art

An ink droplet jet device is conventionally utilized in a piezoelectric ink jet printer head. In such a printer head, a volume of an ink channel is changed by a change in dimension of a piezoelectric transducer, and ink in the ink channel is jetted from an ink outlet nozzle. That is, when the volume in the ink channel is decreased, ink in the ink channel receives a positive pressure and is jetted from the nozzle, while when the volume is increased, ink receives a negative pressure and is introduced through a valve from an ink supplying portion into the ink channel. This type of ink droplet jet device is called a drop on-demand system. In such a device, a plurality of such jet units are arranged close to one another, and ink is jetted from each nozzle communicating with each ink channel to correspond to an image signal, thus forming desired characters and images on a recording medium such as paper.

This kind of ink droplet jet device is described, for example, in U.S. Pat. Nos. 4,879,568 and 4,887,100.

First, a construction of an ink channel array of the conventional ink droplet jet device is described with reference to FIGS. 4 and 5. FIG. 4 is a sectional view of an array constituting a part of the conventional droplet jet device. FIG. 5 is a perspective view illustrating a manufacturing method of an array constituting a part of the conventional ink droplet jet device.

The array of the conventional droplet jet device comprises a piezoelectric ceramic plate 101, a cover plate 121, a plurality of electrodes 111A–D and a nozzle plate 141.

The piezoelectric ceramic plate 101 is polarized in a direction of an arrow 151 and has a plurality of side walls 102. A groove 103 is formed between the pair of side walls 102, which is an ink channel as mentioned below. The groove 103 has a rectangular shape and has a width of about 80 μm (micro-meter), a height of about 200 μm and a length of about 10 mm.

The cover plate 121 is formed of a metal material, glass material or ceramic material. The cover plate 121 is bonded on the upper surface 104A of the piezoelectric ceramics plate 101, that is on the upper surface of the plurality of side walls 102 by an adhesive layer 112 such as epoxy adhesive. With this construction, a plurality of ink channels 131A–D are formed so as to be spaced from one another in a lateral direction. Each ink channel has a rectangular shape having a rectangular cross section. As shown in FIG. 5, each side wall 102 extends over a full length of each ink channel 131A–D, and is deformable in the direction perpendicular to an axis of each ink channel and the polarizing direction 151. The volume in the ink channel 131 is changed by the deformation of each side wall 102, so that an ink pressure in any of the ink channels 131A–D can be changed.

The metal electrodes 111A–D for generating a driving electric field are formed on a surface of each side wall 102. The metal electrodes 111A–D are surface-treated to prevent corrosion thereof by the ink.

The nozzle plate 141 is a plate formed, for example, by a nickel electroforming, and is fixed to one end surface 104B of the piezoelectric ceramic plate 101 and the cover plate 121. A plurality of ink outlets, that is jet nozzles 142, are arranged in the nozzle plate 141, such that the jet nozzles 142 communicate with each of ink channels 131A–D in one-to-one correspondence to each other. A hole diameter of the jet nozzle is, for example, 30 μm, and a distance between centers of the jet nozzles is 160 μm. The ink which receives a positive pressure by the deformation of each ink channel 131A–D is jetted from the jet nozzle 142.

Next, the operation of the array constituting a part of the conventional ink droplet jet device is described with reference to FIG. 4.

When the ink channel 131B in the array is selected according to desired print data, for example, a driving electric field is generated between the metal electrodes 111A and 111B and between the metal electrodes 111C and 111D. A positive electric potential such as 30V is applied to the metal electrodes 111A and 111D, and a negative electric potential such as −30V is applied to the metal electrodes 111B and 111C. The driving electric field is then generated on the side wall 102B in the direction from the metal electrode 111A to the metal electrode 111B, while the driving electric field is generated on the side wall 102C in the direction from the metal electrode 111D to the metal electrode 111C. As the driving electric field direction generated on the side wall 102B and the side wall 102C and the polarizing direction of the piezoelectric ceramic plate 101 are perpendicular to each other, the side wall 102B and the side wall 102C are deformed in the internal direction of the ink channel 131B by a piezoelectric thickness slip effect.

This deformation causes a decrease in volume of the ink channel 131B to result in an increase in ink pressure in the ink channel 131B. Accordingly, an ink droplet in the ink channel 131B is jetted from the jet nozzle 142. When the application of the electric potential is stopped, the side walls 102B and 102C return to their original positions before deformation, so that the ink pressure in the ink channel 131B is decreased, and ink is supplied from an ink supply section (not shown) into the ink channel 131B.

The manufacturing method of the above-mentioned array is explained briefly. First, the piezoelectric ceramic plate 101 having a plurality of grooves 103 is manufactured by the following method. As shown in FIG. 5, the piezoelectric ceramic plate 101 polarized in the direction of an arrow 151 is machined by grinding or the like, such as by rotation of a diamond cutting disk to form a plurality of parallel grooves 103 comprising the above-configured ink channels 131A–D.

Next, the above-mentioned metal electrodes 111A–D are formed on a side surface of each groove 103 by a well-known sputtering method.

Further, the cover plate 121 is bonded to an upper surface 104A of the piezoelectric ceramic plate 101 by the adhesive layer 112. The adhesive layer 112 includes epoxy adhesive and exhibits elasticity. The plurality of ink channels 131A–D are then defined by each groove 103 and the cover plate 121.

Lastly, the nozzle plate 141 having a plurality of jet nozzles 142 at positions corresponding to end positions of the ink channels 131A–D is bonded to an end surface 104B of the piezoelectric ceramic plate 101 on the ink jet side.

However, in this type of the ink droplet jet device, fine grooves must be made on the piezoelectric ceramic plate for forming a plurality of ink channels, in order to obtain an image of a high resolution formed by the jetted ink droplets. For that purpose, the interval between adjoining ink channels must be very small and a number of jet nozzles formed in the nozzle plate must be increased, causing a complicated grooving of the piezoelectric ceramic plate and, accordingly, increasing a manufacturing cost. Further, the conventional groove forming method has a limitation in a width and a distance between centers of the grooves which can be formed. Therefore, only an image of low resolution can be obtained in using the conventional droplet jet device.

SUMMARY OF THE INVENTION

An object of the present invention is to provide an ink droplet jet device which can reduce a manufacturing cost and can produce a printed image having a high resolution, thus solving the above-mentioned problems.

According to the present invention achieving the above object, an ink droplet jet device having a jet unit for jetting ink in an ink channel by changing a volume of the ink channel using a piezoelectric transducer includes: a base plate having at least a pair of first side walls formed by piezoelectric ceramic material, the first side walls defining at least one groove having a width which is wider than a width of the ink channel; a cover plate mounted on the base plate having at least one second side wall having a width which is narrower than the width of the groove, wherein the cover plate is bonded to the base plate so that the second side wall is arranged substantially at a center of the groove and so that a plurality of ink channels are formed by the first side walls, the second side wall and the groove.

With this construction, side walls of the piezoelectric transducer forming a part of the ink channel are deformed by the piezoelectric thickness slip effect due to generation of a driving electric field, and an ink droplet is jetted from the groove to the ink channel, thus supplying ink to the ink channel.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENT

A preferred embodiment of the present invention will now be described with reference to the drawings.

Figure 1:
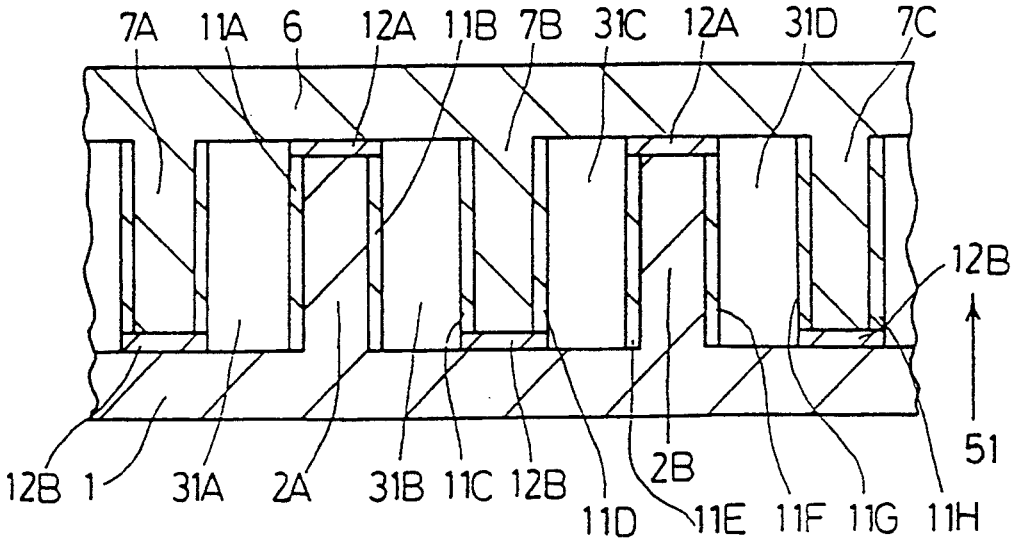
FIG. 1 is a sectional view of an ink channel array comprising a part of an ink droplet jet device according to a preferred embodiment of the present invention.
Figure 2:
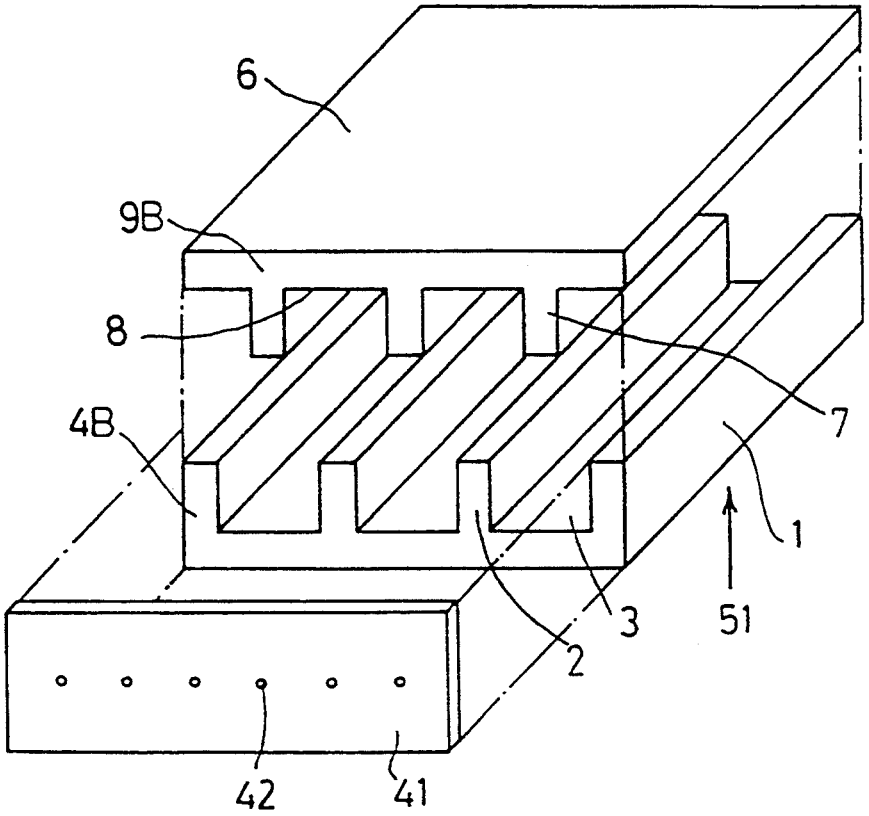
FIG. 2 is a perspective view illustrating a manufacturing method of an ink channel array comprising a part of the ink droplet jet device according to a preferred embodiment of the present invention.

Referring first to FIGS. 1 and 2, a construction of an ink channel array of an ink droplet jet device of the present invention is described. FIG. 1 is a partial cross-sectional view of the ink channel array of the ink droplet jet device. FIG. 2 is a perspective view illustrating a manufacturing method of the ink channel array of the ink droplet jet device.

The ink droplet jet device comprises two piezoelectric ceramic plates 1, 6, a plurality of metal electrodes 11A–H, and a nozzle plate 41.

The piezoelectric ceramic plate 1 which is a first piezoelectric transducer has a plurality of side walls 2 which are first walls. The piezoelectric ceramic plate 1 is polarized in the direction indicated by an arrow 51. The side wall 2 has a width of about 80 μm, a height of about 200 μm and a length of about 10 mm. A first groove 3 which is formed between the pair of side walls 2, has a width of about 240 μm, a height of about 200 μm and a length of about 10 mm.

The piezoelectric ceramic plate 6 which is a second piezoelectric transducer has a plurality of side walls 7 which are second walls. The piezoelectric ceramic plate 6 is also polarized in the direction indicated by arrow 51. The side wall 7 has a width of about 80 μm, a height of about 200 μm and a length of about 10 mm. A second groove 8 which is formed between the pair of side walls 7, has a width of about 240 μm, a height of about 200 μm and a length of about 10 mm. As mentioned above, the width of the grooves 3, 8 is three times wider than that of the side walls 2, 7.

As shown in FIG. 1, each upper surface of each side wall and each bottom surface of each groove of the two piezoelectric ceramics plates 1, 6 are adhered through adhesive layers 12A, 12B. The adhesive layer 12A can comprise, for example, epoxy adhesive, and adheres the upper surface of the plurality of side walls 2 of the piezoelectric ceramic plate 1 and the bottom of the groove 8 formed by the plurality of side walls 7 of the piezoelectric ceramics plate 6. The adhesive layer 12B also can comprise the epoxy adhesive, and adheres the upper surface of the plurality of side walls 7 of the piezoelectric ceramics plate 6 and the bottom of the groove 3 formed by the plurality of side walls 2 of the piezoelectric ceramic plate 1. This epoxy adhesive exhibits elasticity.

When two piezoelectric ceramic plates 1, 6 are thus adhered, a plurality of ink channels 31A–D are so formed as to be spaced from one another in the lateral direction by the plurality of side walls 2 of the piezoelectric ceramic plate 1 and the plurality of side walls 7 of the piezoelectric ceramic plate 6. Each of ink channels 31A–D has a rectangular shape having a rectangular cross section, and each side wall 2 and side wall 7 extends over a full length of each of ink channels 31A–D. Further, each side wall 2 and side wall 7 is deformable in a direction perpendicular to an axis of each of ink channels 31A–D and the polarizing direction 51. A volume in any of the ink channels 31A–D is changed by the deformation of each side wall 2, 7, so that an ink pressure in the ink channel 31 can be changed.

A plurality of metal electrodes 11A–H for generating a driving electric field are formed on each side surface of each side wall 2, 7 by a well-known sputtering method. The metal electrodes 11A–H are surface-treated to prevent corrosion by the ink.

The nozzle plate 41 is a plate formed by a resin. A plurality of ink outlets, i.e., jet nozzles 42 are arranged in the nozzle plate 41, such that the jet nozzles 42 communicate with each of ink channels 31A–D in one-to-one correspondence to each other. A hole diameter of this jet nozzle 42 is approximately 30 μm and a distance between centers of adjacent jet nozzles is about 160 μm. The ink in any of the ink channels 31A–D which receives a positive pressure by the deformation of each side wall 2, 7 is jetted from the jet nozzle 42. Further, the nozzle plate 41 is fixed to end surfaces 4B, 9B of the ink jet side of the piezoelectric ceramic plates 1, 6.

Figure 3A:
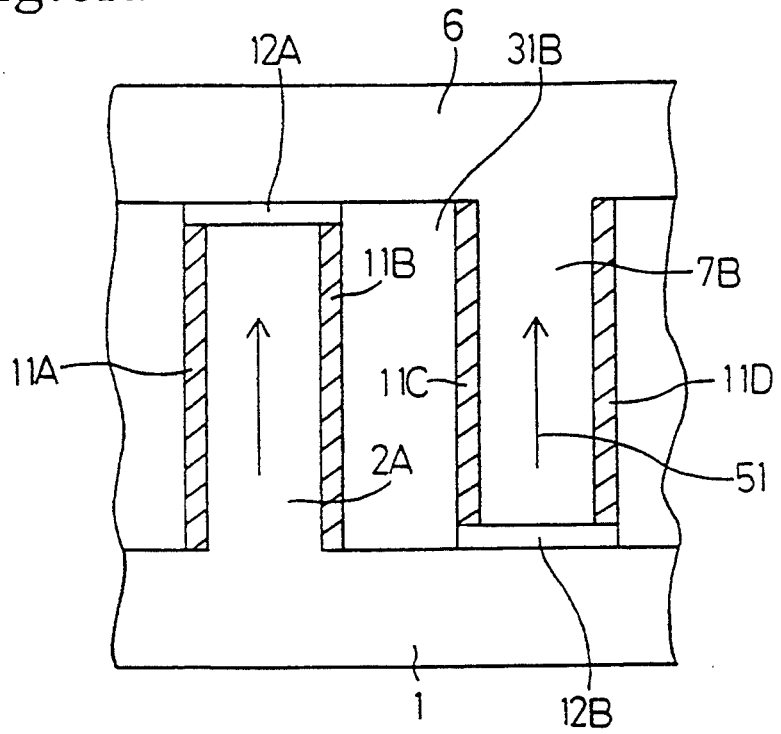
FIG. 3A is a sectional view of an ink channel illustrating a condition where a driving electric field is not generated.
Figure 3B:
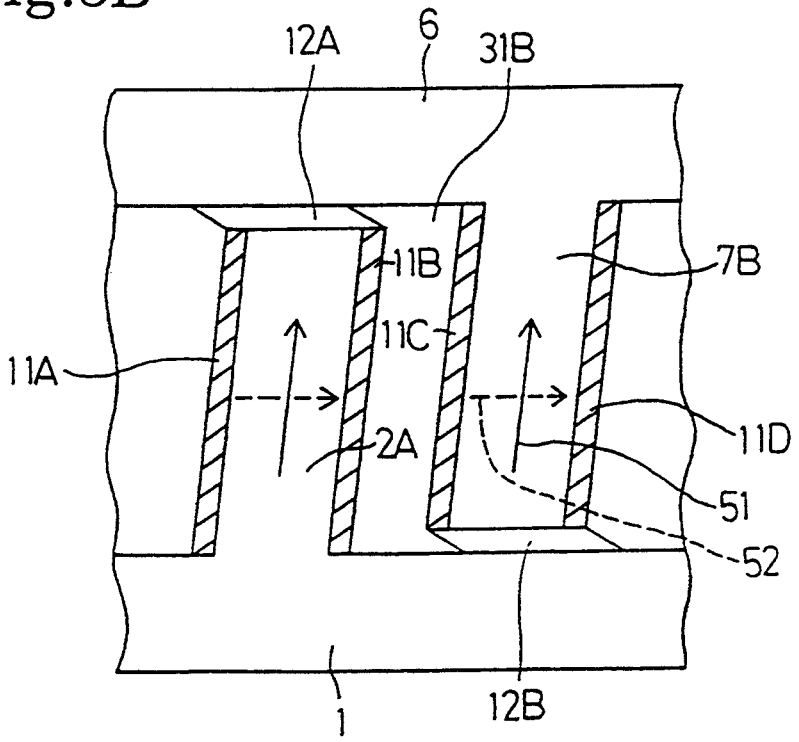
FIG. 3B is a sectional view of an ink channel illustrating a condition where a driving electric field is generated.
Figure 4:
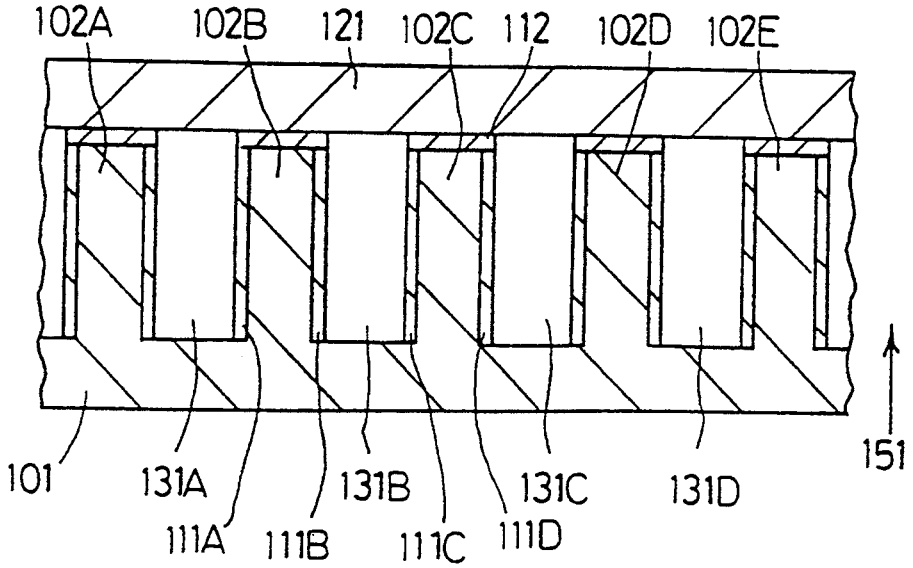
Fig.4 RELATED ART
FIG. 4 is a sectional view of an array comprising a part of an ink droplet jet device in the prior art.
Figure 5:
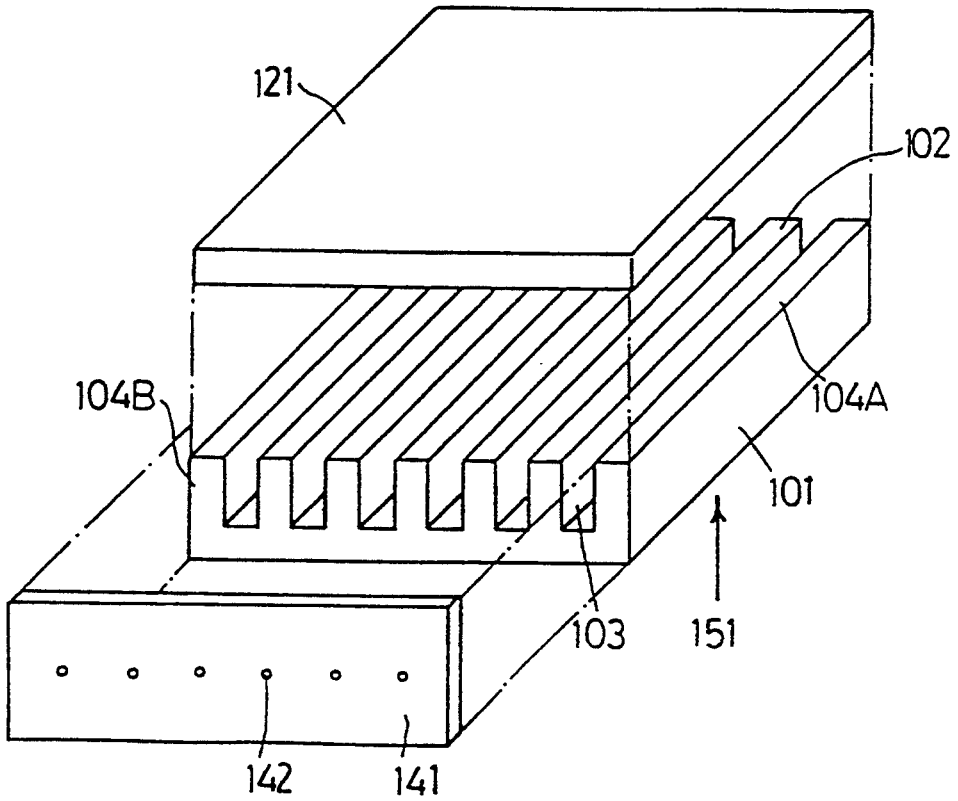
Fig.5 RELATED ART
FIG. 5 is a perspective view illustrating a manufacturing method of an array comprising a part of the ink droplet jet device in the prior art.

Next, the operation of the ink channel array of the ink droplet jet device of the present embodiment is explained with reference to FIGS. 2, 3A, and 3B. FIG. 3A is a partial cross-sectional view of the ink channel illustrating a condition where a driving electric field is not generated. FIG. 3B is a partial cross-sectional view of the ink channel illustrating a condition where a driving electric field is generated. However, these figures are illustrated considerably emphasizing the movement thereof to facilitate understanding of the operation.

The operation of the ink droplet jet device, when the ink channel 31B is, for instance, selected according to predetermined print data, will now be explained.

As shown in FIG. 3A, the driving electric field is not initially generated in the side walls 2A, 7B. When the ink channel 31B is selected, a positive electric potential such as 30V is rapidly applied to the metal electrodes 11A, 11C, and a negative electric potential such as −30V is rapidly applied to the metal electrodes 11B, 11D. Therefore, as shown in FIG. 3B with a dashed line, the driving electric field is generated in the direction 52 from the metal electrode 11A to metal electrode 11B and from the metal electrode 11C to metal electrode 11D, respectively. As the direction 52 of the driving electric field generated on the side walls 2A, 7B and the polarizing direction 51 of the piezoelectric ceramic plates 1, 6 (shown in FIG. 3B with a solid line) are substantially perpendicular to each other, the side walls 2A, 7B are rapidly deformed in the internal direction of the ink channel 31B by the thickness shear mode of shape distortion or transformation of a piezoelectric aramic board. This rapid deformation causes a decrease in volume of the ink channel 31B to increase an ink pressure in the ink channel 31B, and, accordingly, an ink droplet in the ink channel 31B is jetted from the jet nozzle 42, and is recorded on the recording medium such as ordinary paper. At this time, the adhesive layers 12A, 12B, comprising an epoxy adhesive having some elasticity themselves are deformed as shown in FIG. 3B. After the ink is jetted out, the electric potential applied to the metal electrodes 11A, 11B, 11C, and 11D is removed slowly. Thereafter, the side walls 2A, 7B slowly return to their original positions before deformation, and finally return to the position before application of the electric potential as shown in FIG. 3A.

In order to slowly increase the volume of the ink channel 31B, the ink pressure in the ink channel 31B is increased. An ink is then slowly supplied from an ink supply section (not shown) into the ink channel 31B. As mentioned above, the side walls 2A, 7B slowly return to their original positions, so that the volume of the ink channels 31A, 31C adjacent to the ink channel 31B slowly decrease. However, the ink is not jetted from each jet nozzle 42 communicating with the ink channels 31A, 31C, because the volume decreases slowly.

Though only the movement of the ink channel 31B is described above, the other ink channels 31A, 31C, and 31D are also operated in a similar manner as the ink channel 31B. An image is recorded on the recording medium by selectively operating each ink channel 31A–D according to predetermined print data.

Next, the manufacturing method of the ink channel array of the ink droplet jet device of this embodiment is explained with reference to FIGS. 1 and 2.

The manufacturing method of the piezoelectric ceramic plates 1, 6 is initially explained. First, a plurality of parallel grooves 3 are formed on the piezoelectric ceramic plate polarized in the direction of an arrow 51 by grinding or the like, such as by rotation of a diamond cutting disk. The width of the groove 3 (about 240 μm) is three times wider than the width of the ink channels 31A–D (about 80 μm). Thus, the piezoelectric ceramic plate 1 is formed. Next, a plurality of parallel grooves 8 are formed on the piezoelectric ceramic plate polarized in the direction of an arrow 51 by grinding or the like, such as by rotation of a diamond cutting disk. The width of the groove 8 (about 240 μm) is three times wider than the width of the ink channels 31A–D (about 80 μm). Thus, the piezoelectric ceramic plate 6 is formed. The width of the grooves 3, 8 formed on the piezoelectric ceramic plates 1, 6 is three times wider than that of the grooves 103 (about 80 μm) of the conventional piezoelectric ceramic plate 101 which was explained with reference to the related art, so that the grinding of the piezoelectric ceramic plate for forming the grooves is easily performed.

Next, the metal electrodes 11A–H are formed on both surfaces of each groove 3, 8 by a well-known sputtering method.

Two piezoelectric ceramic plates 1, 6 are then bonded by the adhesive layer 12A, 12B. The adhesive layer 12A comprises, for example, epoxy adhesive, and adheres the upper surface of the plurality of side walls 2 of the piezoelectric ceramic plate 1 to the bottom of the groove 8 formed by the plurality of side walls 7 of the piezoelectric ceramic plate 6. The adhesive layer 12B also comprises, for example, epoxy adhesive, and adheres the upper surface of the plurality of side walls 7 of the piezoelectric ceramic plate 6 to the bottom of the groove 3 formed by the plurality of side walls 2 of the piezoelectric ceramic plate 1. Side walls 2,7 are bonded substantially at the center of grooves 8,3, respectively. Therefore, a plurality of ink channels 31 are formed. At this time, it is important that each ink channel 31 has substantially the same width of approximately 80 μm. If the width is not equal, the amount of ink jetted from each jet nozzle 42 becomes uneven. Accordingly, an excellent image cannot be formed on the recording medium.

Next, the nozzle plate 41 having the jet nozzles 42 is bonded to the end surfaces 4B, 9B of the ink jet sides of the piezoelectric ceramic plates 1, 6. Each jet nozzle 42 communicates with each of ink channels 31A–D in one-to-one correspondence to each other.

As mentioned above, in the ink channel array of the ink droplet jet device of this embodiment, the width of the grooves 3, 8 formed on the piezoelectric ceramic plates 1, 6 becomes wider than the width of ink channel 31. Therefore, when the distance between adjoining ones of ink channels 31A–D becomes very small to increase a number of jet nozzles which communicate with the ink channels and which are formed in the nozzle plate in order to obtain an image of a high resolution formed by the jetted ink droplet, the groove processing of the piezoelectric ceramic plate is facilitated in comparison with a conventional method, thereby reducing manufacturing cost. Further, there is a limitation in a width and a length of the grooves which can be formed in a groove forming method such as a grinding method. However, according to the manufacturing method of the present invention, it is possible to obtain fine grooves with an easy groove processing. For instance, if the width of each groove 3, 8 is processed to be narrower than about 240 μm, and the width of each side wall 2, 7 is formed narrower than about 80 μm, it is possible to increase the number of ink channels, and to obtain an image of high resolution.

As apparent from the above description, according to the droplet jet device of the present invention, grooving of the piezoelectric ceramics plate is facilitated, thereby reducing a manufacturing cost. Further, it is possible to produce an image of high resolution.

It is to be understood that the present invention is not restricted to the particular forms shown in the foregoing embodiment, and various modifications and alterations can be added thereto without departing from the scope of the invention encompassed by the appended claims.

For instance, in the above-mentioned embodiment, two piezoelectric ceramic plates were used. However, both of the plates need not be piezoelectric transducers. One of them can be made of a resin or a metallic material having the same shape as the other confronting piezoelectric ceramic plate. In this case, only one side wall of the ink channel becomes the piezoelectric transducer.

Further, the adhesive layer 12 need not fix the piezoelectric ceramic plate 1, 6. A thin layer of a material with low elasticity or a stripping seal can be used in order to transform the side walls 2, 7 easily. Moreover, the piezoelectric ceramic plates 1, 6 can be engaged only in pressurization by tightening bolts.

Further, a direction of the polarization of each piezoelectric ceramics plate can be reverse that of the direction indicated by the arrow 51. In this case, the direction of the driving electric field to be generated in the side wall must be reversed.

Further, the timing of application of the voltage for jetting the ink droplet and for supplying the ink can be reversed to that of the above-mentioned embodiment. That is, the side walls 2A, 7B are slowly deformed in the external direction of the ink channel 31B by a piezoelectric thickness slip effect according to slow application of the driving voltage. With this deformation, the volume in the ink channel 31B is increased slowly and the ink pressure is decreased slowly, and an ink is slowly supplied from an ink supply section (not shown) into the ink channel 31B. When the application of the driving voltage is rapidly stopped, the side walls rapidly return to the original position before deformation, the ink pressure increases rapidly, and the ink droplet is jetted from the jet nozzle.

What is claimed is:

1. A droplet jet device having a jet unit for jetting ink in a plurality of ink channels by changing a volume of said ink channels with use of a piezoelectric transducer, comprising:

a base plate having a plurality of spaced apart first side walls extending therefrom and defining first grooves therebetween, each of said first side walls being formed of piezoelectric ceramic material and having a predetermined width, said first side walls each having two sides;

a cover plate mounted on said base plate and having a plurality of second side walls spaced apart and defining second grooves therebetween of a width greater than the predetermined width of each of said first side walls; and means for bonding said cover plate and base plate so that at least one of said first side walls is arranged substantially at a center of at least one of said second grooves and at least one of said second side walls is arranged substantially at a center of at least one of said first grooves, thereby defining said plurality of ink channels; wherein said first grooves have a width greater than a width of said ink channels.

2. The droplet jet device according to claim 1, further comprising electrodes provided on both sides of said first side walls.

3. The droplet jet device according to claim 1, wherein said second side walls are formed of piezoelectric ceramic material.

4. The droplet jet device according to claim 3, wherein said second side walls have two sides and electrodes are provided on both sides of said second side walls.

5. The droplet jet device according to claim 1, wherein said first grooves and said second grooves have substantially the same width and said first and second side walls have substantially the same width.

6. The droplet jet device according to claim 5, wherein the width of each of said first grooves and the width of said second groove is substantially three times wider than the width of each of said ink channels.

7. The droplet jet device according to claim 6, wherein an upper surface of said first side walls is adhered to a bottom surface of said second grooves through said bonding means and upper surfaces of said second side walls are adhered to a bottom surface of said first grooves through said bonding means.

8. The droplet jet device according to claim 7, wherein said bonding means comprises an epoxy adhesive.

9. The droplet jet device according to claim 1, wherein said base plate and said cover plate have end surfaces and a nozzle plate is positioned to abut said end surfaces, said nozzle plate having jet nozzles extending therethrough, each of said jet nozzles corresponding to one of said ink channels.

10. A droplet jet device having a jet unit for jetting ink in a plurality of ink channels by changing a volume of said ink channels with use of a piezoelectric transducer, comprising:

a piezoelectric transducer having a plurality of spaced apart first side walls formed of piezoelectric ceramic material and defining a plurality of first grooves therebetween each of said plurality of first side walls having two sides;

a cover plate mounted on said piezoelectric transducer having a plurality of spaced apart second side walls which define a plurality of second grooves therebetween having a width which is wider than the width of said ink channels, each of said plurality of second side walls having two sides; and means for bonding said cover plate and said piezoelectric transducer so that at least one of said first side walls is arranged substantially at a center of one of said second grooves and at least one of said second side walls is arranged substantially at a center of one of said first grooves, thereby defining said plurality of ink channels; wherein said first grooves have a width greater than a width of said ink channels.

11. The droplet jet device according to claim 10, wherein said second side walls are formed of piezoelectric ceramic material.

12. The droplet jet device according to claim 11, further comprising electrodes provided on both sides of said first and second side walls.

13. The droplet jet device according to claim 10, wherein said first grooves and said second grooves have substantially the same width and said first and second side walls have substantially the same width.

14. The droplet jet device according to claim 13, wherein the width of each of said first grooves and the width of each of said second grooves is substantially three times wider than the width of each of said ink channels.

15. The droplet jet device according to claim 14, wherein upper surfaces of said first side walls are adhered to a bottom surface of said second grooves through an adhesive layer and upper surfaces of said second side walls are adhered to a bottom surface of said first grooves through an adhesive layer.

16. The droplet jet device according to claim 15, wherein said adhesive layer comprises an epoxy adhesive.

17. The droplet jet device according to claim 10, wherein said first piezoelectric transducer and said cover plate have end surfaces and a nozzle plate abuts said end surfaces, said nozzle plate having jet nozzles for jetting ink extending therethrough, each of said jet nozzles corresponding to one of said ink channels.

18. A droplet jet device having a jet unit for jetting ink in ink channels by changing a volume of said ink channels with use of a piezoelectric transducer, comprising:

a base plate having a plurality of spaced apart first side walls extending therefrom and defining first grooves therebetween, each of said first side walls being formed of piezoelectric ceramic material and having a predetermined width, said first side walls each having two sides;

a cover plate mounted on said base plate and having a plurality of spaced apart second side walls extending therefrom and defining second groves therebetween of a width greater than the predetermined width of each of said first side walls; and means for bonding said cover plate and base plate so that at least one said first side walls is arranged substantially at a center of at least one of said second grooves and at least one of said second side walls is arranged substantially at a center of at least one of said first grooves, thereby defining said plurality of ink channels; wherein said first grooves have a width greater than a width of said ink channels; wherein said base plate and cover plate have end surfaces, and a nozzle plate is positioned to abut said base plate and said cover plate end surfaces, said nozzle plate having jet nozzles extending therethrough, each of said jet nozzles corresponding to one of said ink channels.

19. The droplet jet device of claim 1, wherein said first grooves and said second grooves are about 240 micrometers in width.

20. The droplet jet device of claim 1, wherein said first grooves and said second grooves are less than 240 micrometers in width and said first side walls and said second side walls are less than 80 micrometers in width, providing a high resolution device having a center-to-center spacing of ink jet nozzles of less than 160 micrometers.

* * * * *